US012140005B2

(12) United States Patent
Brown et al.

(10) Patent No.: US 12,140,005 B2
(45) Date of Patent: Nov. 12, 2024

(54) ANTI-SPIN CONTROL FOR AN ELECTRIC SUBMERSIBLE PUMP PERMANENT MAGNET MOTOR

(71) Applicant: Halliburton Energy Services, Inc., Houston, TX (US)

(72) Inventors: Donn J. Brown, Broken Arrow, OK (US); Ketankumar Kantilal Sheth, Tulsa, OK (US); Dezhi Zheng, Bixby, OK (US)

(73) Assignee: Halliburton Energy Services, Inc., Houston, TX (US)

( * ) Notice: Subject to any disclaimer, the term of this patent is extended or adjusted under 35 U.S.C. 154(b) by 184 days.

(21) Appl. No.: 17/748,833

(22) Filed: May 19, 2022

(65) Prior Publication Data

US 2023/0374982 A1 Nov. 23, 2023

(51) Int. Cl.
*E21B 43/12* (2006.01)

(52) U.S. Cl.
CPC ..... *E21B 43/128* (2013.01); *F04B 2205/09* (2013.01)

(58) Field of Classification Search
CPC ..... E21B 43/128; E21B 34/08; E21B 34/085
See application file for complete search history.

(56) References Cited

U.S. PATENT DOCUMENTS

| | | | | |
|---|---|---|---|---|
| 9,181,785 | B2 | 11/2015 | Lawson et al. | |
| 10,677,032 | B1 | 6/2020 | Norton | |
| 10,947,813 | B2 | 3/2021 | Ejim et al. | |
| 11,319,786 | B2 | 5/2022 | Brown et al. | |
| 2009/0272538 | A1 | 11/2009 | Kennedy | |
| 2010/0108307 | A1 | 5/2010 | Brown et al. | |
| 2010/0126721 | A1 | 5/2010 | Al-Jarri et al. | |
| 2012/0160563 | A1* | 6/2012 | Clark | E21B 17/1014 175/73 |
| 2012/0160564 | A1* | 6/2012 | Downton | E21B 7/062 175/73 |
| 2013/0277119 | A1* | 10/2013 | Rogers | E21B 47/18 175/317 |
| 2016/0194928 | A1 | 7/2016 | Delmar et al. | |
| 2016/0281449 | A1* | 9/2016 | Lorenson | E21B 21/10 |

(Continued)

FOREIGN PATENT DOCUMENTS

| | | |
|---|---|---|
| CN | 202788749 | 3/2013 |
| WO | 2013155257 | 10/2013 |

OTHER PUBLICATIONS

"PCT Application No. PCT/US2023/061612, International Search Report and Written Opinion", May 24, 2023, 11 pages.

(Continued)

*Primary Examiner* — David Carroll
(74) *Attorney, Agent, or Firm* — DeLizio, Peacock, Lewin & Guerra, LLP

(57) ABSTRACT

Provided, in one aspect, is a spin control valve assembly, comprising a stationary valve plate having a first stationary valve plate opening and a second stationary valve plate opening; and a rotating valve plate coupled longitudinally adjacent to the stationary valve plate, the rotating valve plate having a rotating valve plate opening, wherein the rotating valve plate is configured to rotate among at least three positions such that at each position of the at least three positions fluid flows at a different flow rate through the spin control valve assembly.

20 Claims, 5 Drawing Sheets

(56) References Cited

U.S. PATENT DOCUMENTS

| | | | | |
|---|---|---|---|---|
| 2016/0369788 | A1 | 12/2016 | Brown et al. | |
| 2018/0329093 | A1 | 11/2018 | Kusko et al. | |
| 2019/0024459 | A1* | 1/2019 | Sicilian | E21B 6/04 |
| 2019/0153820 | A1* | 5/2019 | Lorenson | F03C 2/08 |
| 2019/0360302 | A1* | 11/2019 | Nowitzki | E21B 43/128 |
| 2020/0056451 | A1* | 2/2020 | Chambers | E21B 21/10 |
| 2020/0063525 | A1 | 2/2020 | Frazier et al. | |
| 2020/0141187 | A1 | 5/2020 | Lorenson et al. | |
| 2021/0164307 | A1 | 6/2021 | Hicks et al. | |
| 2021/0363998 | A1 | 11/2021 | Brown et al. | |
| 2022/0025738 | A1 | 1/2022 | Nowitzki et al. | |
| 2023/0027048 | A1* | 1/2023 | Oberlin | E21B 7/24 |

OTHER PUBLICATIONS

"PCT Application No. PCT/US2020/016550 International Search Report and Written Opinion", Oct. 20, 2020, 12 pages.
"U.S. Appl. No. 16/778,455 Office Action", Nov. 2, 2021, 15 pages.
"CA Application No. 3,161,241, First Examiners Report", Oct. 12, 2023, 10 pages.

* cited by examiner

ANTI-SPIN CONTROL FOR AN ELECTRIC SUBMERSIBLE PUMP PERMANENT MAGNET MOTOR

BACKGROUND

In the oil and gas industry, electric submersible pumps (ESPs) are used for the recovery of oil and gas from subsurface formations. ESPs are often suspended vertically in a wellbore and are connected by a cable to a motor which drives the ESP. ESPs are often driven by a Permanent Magnet Motor (PMM). There are there are inherent problems associated with installations into and pulls from a wellbore when using a PMM with an ESP. When installing or pulling the PMM, the motor may spin backwards due to liquid moving through the pump stages as the pump moves through the liquid. The backward rotation of the motor creates an electrical current as the reverse rotation of the motor generates electricity. This electrical current may be transferred through the motor cable to the surface of the wellbore and may create a hazardous condition for the personnel at the surface.

BRIEF DESCRIPTION

Reference is now made to the following descriptions taken in conjunction with the accompanying drawings, in which.

DETAILED DESCRIPTION

Figure 1:
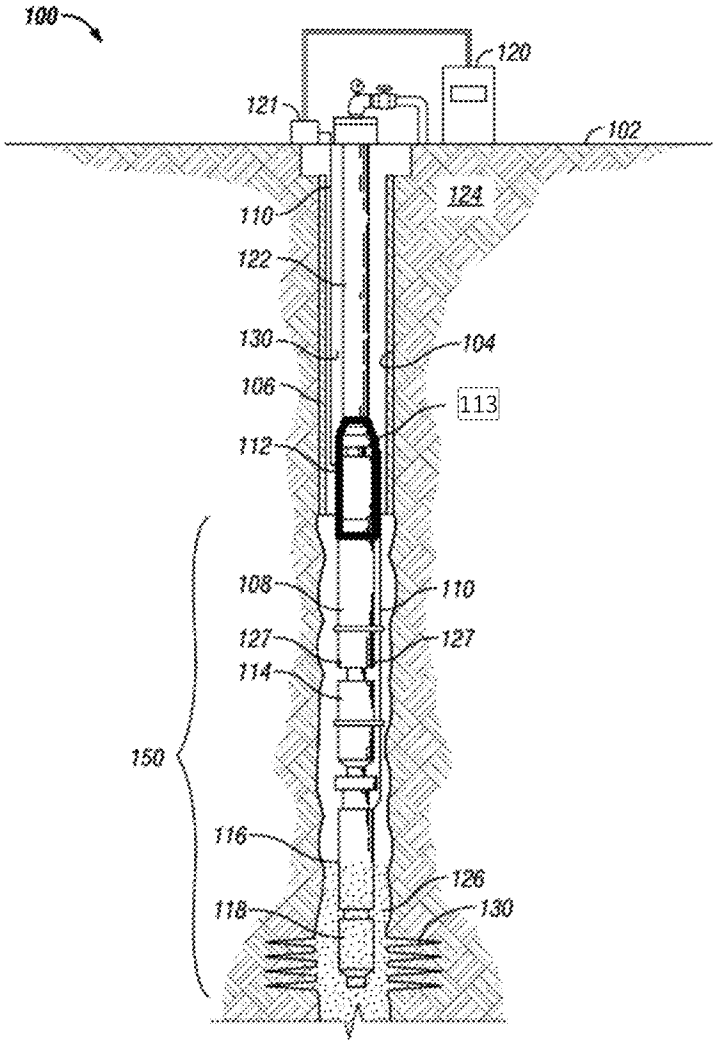
FIG. 1 illustrates a partial cross-sectional view of an example well system for hydrocarbon reservoir production designed and manufactured according to one or more embodiments disclosed herein.

In the drawings and descriptions that follow, like parts are typically marked throughout the specification and drawings with the same reference numerals, respectively. The drawn figures are not necessarily to scale. Certain features of the disclosure may be shown exaggerated in scale or in somewhat schematic form and some details of certain elements may not be shown in the interest of clarity and conciseness. The present disclosure may be implemented in embodiments of different forms.

Specific embodiments are described in detail and are shown in the drawings, with the understanding that the present disclosure is to be considered an exemplification of the principles of the disclosure, and is not intended to limit the disclosure to that illustrated and described herein. It is to be fully recognized that the different teachings of the embodiments discussed herein may be employed separately or in any suitable combination to produce desired results.

Unless otherwise specified, use of the terms "connect," "engage," "couple," "attach," or any other like term describing an interaction between elements is not meant to limit the interaction to a direct interaction between the elements and may also include an indirect interaction between the elements described. Unless otherwise specified, use of the terms "up," "upper," "upward," "uphole," "upstream," or other like terms shall be construed as generally away from the bottom, terminal end of a well; likewise, use of the terms "down," "lower," "downward," "downhole," or other like terms shall be construed as generally toward the bottom, terminal end of the well, regardless of the wellbore orientation. Use of any one or more of the foregoing terms shall not be construed as denoting positions along a perfectly vertical axis. In some instances, a part near the end of the well can be horizontal or even slightly directed upwards. Unless otherwise specified, use of the term "subterranean formation" shall be construed as encompassing both areas below exposed earth and areas below earth covered by water such as ocean or fresh water.

FIG. 1 illustrates one embodiment of an example well system 100 for hydrocarbon reservoir production according to one or more aspects of the present disclosure. While well system 100 illustrates a land-based subterranean environment, the present disclosure contemplates any well site environment including a subsea environment. In one or more embodiments, any one or more components or elements may be used with subterranean operations equipment located on offshore platforms, drill ships, semi-submersibles, drilling barges and land-based rigs.

In one or more embodiments, well system 100 comprises a wellbore 104 below a surface 102 in a formation 124. In one or more embodiments, wellbore 104 may comprise a nonconventional, horizontal or any other type of wellbore. Wellbore 104 may be defined in part by a casing 106 that may extend from a surface 102 to a selected downhole location. Portions of wellbore 104 that do not comprise the casing 106 may be referred to as open hole.

In one or more embodiments, various types of hydrocarbons or fluids may be pumped from wellbore 104 to the surface 102 using a pump system 150 disposed or positioned downhole, for example, within, partially within, or outside casing 106 of wellbore 104. In one or more embodiments, pump system 150 may comprise an electrical submersible pump (ESP) system. Pump system 150 may comprise a pump 108, an electrical cable 110, an anti-spin control system 112, a seal or equalizer 114, a motor 116, and a sensor 118. The pump 108 may be an ESP, including but not limited to, a multi-stage centrifugal pump, a rod pump, a progressive cavity pump, any other suitable pump system or combination thereof. The pump 108 may transfer pressure to the fluid 126 or any other type of downhole fluid to propel the fluid from downhole to the surface 102 at a desired or selected pumping rate. In one or more embodiments, pump 108 may be coupled to an anti-spin control system 112. Motor 116 may, in some embodiments, be a permanent magnet motor (PMM) and may be coupled to at least a downhole sensor 118. In one or more embodiments, the electrical cable 110 is coupled to the motor 116 and to controller 120 at the surface 102. The electrical cable 110 may provide power to the motor 116, transmit one or more control or operation instructions from controller 120 to the motor 116, or both. The electrical cable 110 may be communicatively coupled to the controller 120 and also to a flowmeter 121 disposed at the surface 102. Without limitations, the flowmeter 121 may be replaced with any suitable sensor utilized to measure a parameter of the fluid 126.

In one or more embodiments, fluid 126 may be a multiphase wellbore fluid comprising one or more hydrocarbons. For example, fluid 126 may be a two-phase fluid that comprises a gas phase and a liquid phase from a wellbore or reservoir in the formation 124. In one or more embodiments, fluid 126 may enter the wellbore 104, casing 106 or both through one or more perforations in the formation 124 and flow uphole to one or more intake ports 127 of the pump system 150, wherein the one or more intake ports 127 are disposed at a distal end of the pump 108. The pump 108 may transfer pressure to the fluid 126 by adding kinetic energy to the fluid 126 via centrifugal force and converting the kinetic energy to potential energy in the form of pressure. In one or more embodiments, pump 108 lifts fluid 126 to the surface 102.

In one or more embodiments, motor 116 is an electrical submersible motor configured or operated to turn pump 108 and may, for example, be a two or more-pole, three-phase squirrel cage induction motor or a permanent magnet motor (PMM). In one or more embodiments, a production tubing section 122 may couple to the pump 108 using one or more connectors 128 or may couple directly to the pump 108. In one or more embodiments, any one or more production tubing sections 122 may be coupled together to extend the pump system 150 into the wellbore 104 to a desired or specified location. Any one or more components of fluid 126 may be pumped from pump 108 through production tubing 122 to the surface 102 for transfer to a storage tank, a pipeline, transportation vehicle, any other storage, distribution or transportation system and any combination thereof. In some embodiments, the anti-spin control system 112 may include a spin control valve, which may have at least 3 positions for varying the flow from the pump 108 through the anti-spin control system 112. During operations, the spin control valve in one position may enable flow of fluid through the anti-spin control system 112. The spin control valve may be placed in another position and be configured to substantially stop the flow of fluid through the anti-spin control system 112, or if gas is present with the fluid 126, yet another position may enable the gas to be forced out of the pump 108 via the into an annulus 130 of the wellbore 104.

Embodiments of the anti-spin control system 112 described herein may eliminate the rotation of the motor 116 during pulls from and installs into the wellbore 104 by the spin control valve. When the spin control valve is in a third position, the flow of liquid through the pump 108 and production tubing section 122 may be substantially stopped at a flow rate below a no-flow threshold. By substantially eliminating the flow of fluids though the pump 108 and production tubing section 122, the anti-spin control system 112 may eliminate electrical hazards associated at the surface which may occur during installation or pulling of the ESP pump system 150 and also in the event of sudden stopping of the ESP because of the failure. This control of fluid flow may be used multiple times as the ESP pump system 150 is moved within the wellbore 104.

Figure 2B:
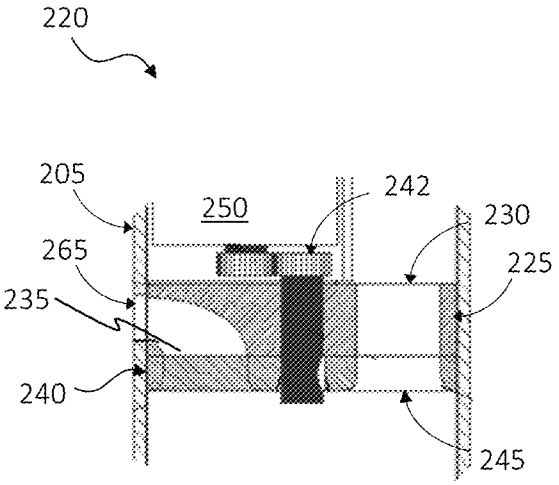
FIG. 2B is a profile view of a spin control valve of the anti-spin control system of FIG. 2A.
Figure 2A:
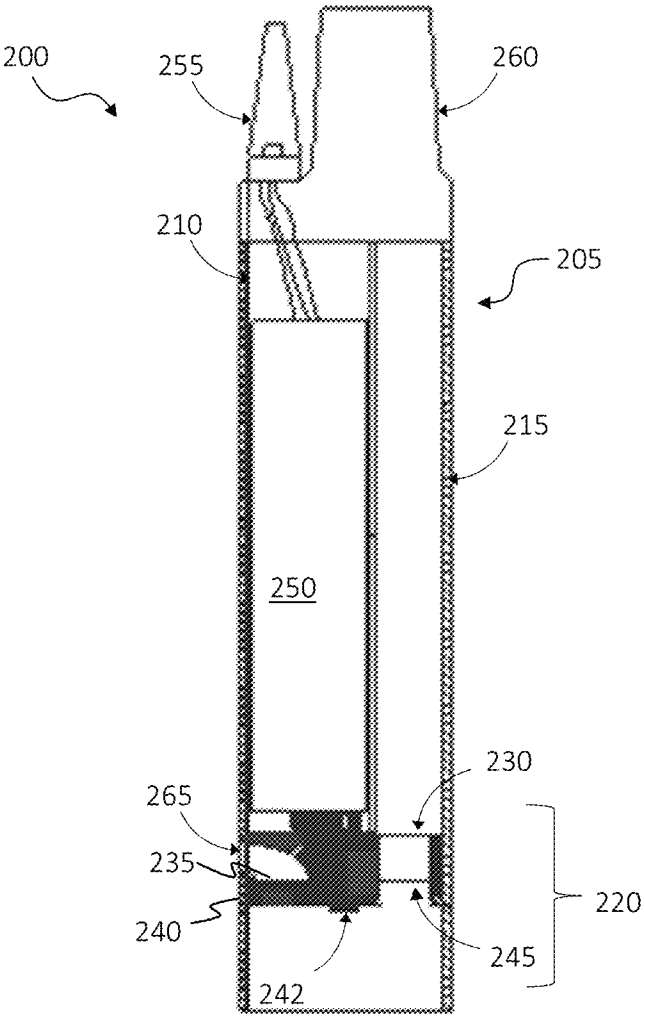
FIG. 2A illustrates one embodiment of an anti-spin control system designed and manufactured according to one or more embodiments of the disclosure.

Referring now to FIG. 2A, there is shown one embodiment of an anti-spin control system 200 which may be used with the pump system 150 and wellbore 104 shown in FIG. 1. The anti-spin control system 200 may include a housing 205 which may in some embodiments be coupled with an uphole end of a pump, such as an ESP. The housing 205 may couple to a downhole end of a casing or production tubing in the wellbore. The housing 205 may include at least a first chamber 210 and a second chamber 215 adjacent to the first chamber 210. The second chamber 215 may be configured for fluid flow therethrough, and in some embodiments couple with production tubing for fluid flow therethrough. A spin control valve 220 may be positioned at a downhole end of the first and second chambers 210 and 215. In some embodiment, the spin control valve 220 may include at least a stationary valve plate 225 that includes at least a first stationary valve plate opening 230 and a second stationary valve plate opening 235. A rotating valve plate 240 may be positioned longitudinally adjacent the stationary valve plate 225. In this embodiment the rotating valve plate 240 is positioned downhole of the stationary valve plate 225. In some embodiments, the rotating valve plate 240 may be coupled with and configured to rotate about a central axis member 242 coupled with the stationary valve plate 225. The rotating valve plate 240 may include a rotating valve plate opening 245. The rotating valve plate 240 may be configured to rotate among at least three positions such that at each position of the at least three positions, fluid may flow through the spin control valve 220 at a different flow rate.

The anti-spin control system 200 may include an actuator 250. The actuator may be positioned within the first chamber 210 and may be coupled with a controller at a surface of the wellbore by a power connection 255. The power connection 255 may be positioned adjacent a production tubing 260 at an uphole end of the housing 205, or in some embodiments may be positioned within the production tubing 260.

The actuator 250 may be configured to control the spin control valve and control rotation of the rotating valve plate 240 between the at least three positions. When the rotating valve plate 240 is in a first position of the at least three positions, the rotating valve plate opening 245 is aligned with the first stationary valve plate opening 230 such that production fluid may flow through the first stationary valve plate opening 230 and the rotating valve plate opening 245 at a first flow rate into the second chamber 215, as shown in FIGS. 2A and 2B. In other embodiments, the actuator 250 may be a hydraulic actuator, a magnetic actuator, or a pneumatic actuator, and in some embodiments may be a combination of types of actuators.

In some embodiments, the spin control valve 220 may also function as a pressure relief valve. When the rotating valve plate 240 is in a second position of the at least three positions, the rotating valve plate opening 245 may be at least partially aligned with the second stationary valve plate opening 235 such that production fluid may flow through the second stationary valve plate opening 235 at a second flow rate that is less than the first flow rate. While in the second position, gas within the production fluid may vent back to the wellbore through an exhaust port 265 in the housing 205 positioned proximate the first stationary valve plate opening 230 of the spin control valve 220. The flow rates may vary according to various environments and conditions within the wellbore.

The controller may be configured to detect a change in current of actuator 250. When current decreases, the controller may determine that an amount of gas in the production fluid has increased. The controller may then signal the actuator 250 to move the rotating valve plate 240 into the second position for venting gas from the production fluid.

In a third position of the at least three positions, the rotating valve plate opening 245 is positioned between the first stationary valve plate opening 230 and the second stationary valve plate opening 235 such that both the first stationary valve plate opening 230 and the second stationary valve plate opening 235 are covered placing the spin control valve 220 in a "stop all flow" position wherein fluid flow through the spin control valve 220 is substantially stopped. The third position of the spin control valve 220 may close both the path of fluid between the production tubing 260 and the pump as well as the exhaust port 265 to the wellbore such that there may be substantially no flow through the valve, or flow below a no-flow threshold. In some embodiments, "substantially stopped" or "substantially no flow" may be defined as no flow. In some other embodiments, "substantially stopped" may be defined relative to a no-flow threshold which may be set at different values. For example, in some implementations, the no-flow threshold is less than five percent. Other example values of the no-flow threshold may be less than one percent, seven percent, 10 percent, etc. When the pump system is being placed into the wellbore, pulled from the wellbore, or moved within the wellbore to a different depth, the spin control valve 220 may be placed in the "stop all flow" position such that fluid flow is substantially stopped. When little or no fluid is flowing through the pump, the motor may not spin and little or no electric current may be generated or transmitted to the surface of the wellbore, thereby limiting an electrical hazard to personnel at the surface of the wellbore. In addition to providing safety protection from an electrical hazard for personnel at the surface, the spin control valve may also be used to perform a controlled release of fluid during a pull from the wellbore, which may avoid pulling a wet production or drill string. In some embodiments, the spin control valve 220 can be positioned in the first position or second position during a "controlled release" procedure when the release can be performed safely regarding personal performing the position change of the pump system.

In some embodiments, an additional port may be added to the spin control valve 220 which when the rotating valve plate 240 is moved into the second position, provides an outlet for the fluid contained in the production string but still allows low to substantially no flow through the pump. In another embodiment, a linear valve system may also be used to control of the liquid flow through the spin control valve 220. The linear valve may include a sliding sleeve, which may be used in place of the rotating valve plate 240 and seat against the stationary valve plate 225. In some embodiments, the actuator 250 may include a spring which may be used to actuate the sliding sleeve into one of three positions relative to the stationary valve plate 225.

Referring to FIG. 2B, there is shown a side profile view of the spin control valve 220 shown in the first position. The rotating valve plate opening 245 is aligned with the first stationary valve plate opening 230 such that fluid flows at a first flow rate through the spin control valve 220 and to the production tubing through the second chamber 215. As shown in FIG. 2B, in some embodiments, the exhaust port 265 may be an opening between the stationary valve plate 225 and the rotating valve plate 240, and in some embodiments. In some embodiments, the rotating valve plate 240 may be formed to provide a channel to the exhaust port 265 below a bottom surface thereof.

Figure 2E:
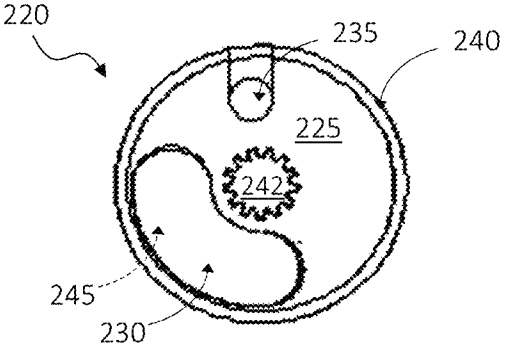
FIG. 2E is a top view illustrating the spin control valve in a first position.
Figure 2F:
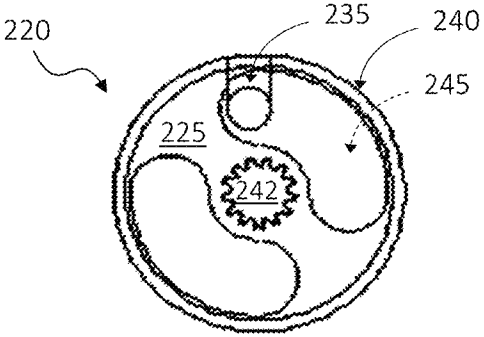
FIG. 2F is a top view illustrating the spin control valve in a second position.
Figure 2G:
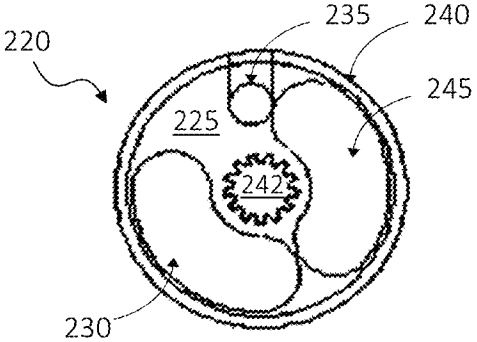
FIG. 2G is a top view illustrating the spin control valve in a third position.
Figure 2C:
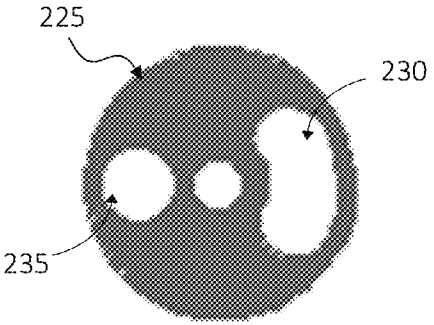
FIG. 2C is a bottom side view of a stationary valve plate of the spin control valve shown in FIG. 2B.
Figure 2D:
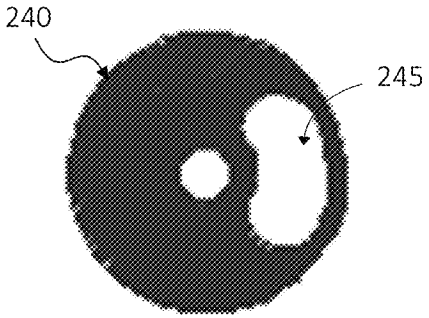
FIG. 2D is a bottom side view of a rotating valve plate of the spin control valve shown in FIG. 2B.

FIG. 2C illustrates a downhole view of the stationary valve plate 225. FIG. 2D illustrates a downhole view of the rotating valve plate 240. Referring now to FIG. 2E through FIG. 2G, there is shown the spin control valve 220 shown in at least three positions. FIG. 2E illustrates the spin control valve 220 in the first position of the at least three positions. As shown in FIG. 2E, the rotating valve plate 240 is positioned such that the rotating valve plate opening 245 is substantially aligned with the first stationary valve plate opening 230. Fluid may flow through the spin control valve 220 into the second chamber 215 and into the production tubing 260 at a first flow rate. In some embodiments, substantially aligned may include the rotating valve plate 240 aligned at least 90 to 100 percent or more with the rotating valve plate opening 245. In other embodiments, substantially aligned may include at least 85 percent alignment.

In some embodiments, the anti-spin control system 200 may be used to help control the intake pressure by throttling the flow through the pump. For example, a larger mixed flow pump may be used initially and as the well depletes over time, the anti-spin control system 200 may be used to close off the production flow to match the well's lower production rate.

FIG. 2F illustrates the spin control valve 220 in the second position of the at least three positions. As shown, the rotating valve plate opening 245 is at least partially aligned with the second stationary valve plate opening 235. In the second position, production fluid may flow through the spin control valve 220 at a second flow rate less than the first flow rate. In addition, gas and in some embodiments, fluid, may be vented back into the wellbore via the exhaust port 265 shown in FIG. 2A In some embodiments, partially aligned may be within 40-60 percent alignment with the second stationary valve plate opening 235.

FIG. 2G illustrates the spin control valve 220 in the third position of the at least three positions. As shown, the rotating valve plate opening 245 is not aligned with either the first or second stationary valve plate openings 230 and 235. Both of the openings 230 and 235 may be substantially blocked and fluid flow through either the openings 230 and 235 and the spin control valve 220 is substantially stopped. During operation, the spin control valve 220 may be placed in this third position during installation of the pump system into wellbore, when pulling the pump system from the wellbore, and also when the pump system may be moved to a different depth within the wellbore.

Although the spin control valve 220 is shown having a generally circular shape, The shape of the spin control valve 220 and also the stationary valve plate 225 and the rotating valve plate 240 may be formed as a square, a polygon, and various other shapes that are able to facilitate the flow from the pump. The various components of the spin control valve 220, including the stationary valve plate 225 and the rotating valve plate 240, may comprise various materials, including, but not limited to stainless steel, hardened steel, ceramics, and carbides including Tungsten carbide, chromium carbide, and silicon carbide.

Figure 3:
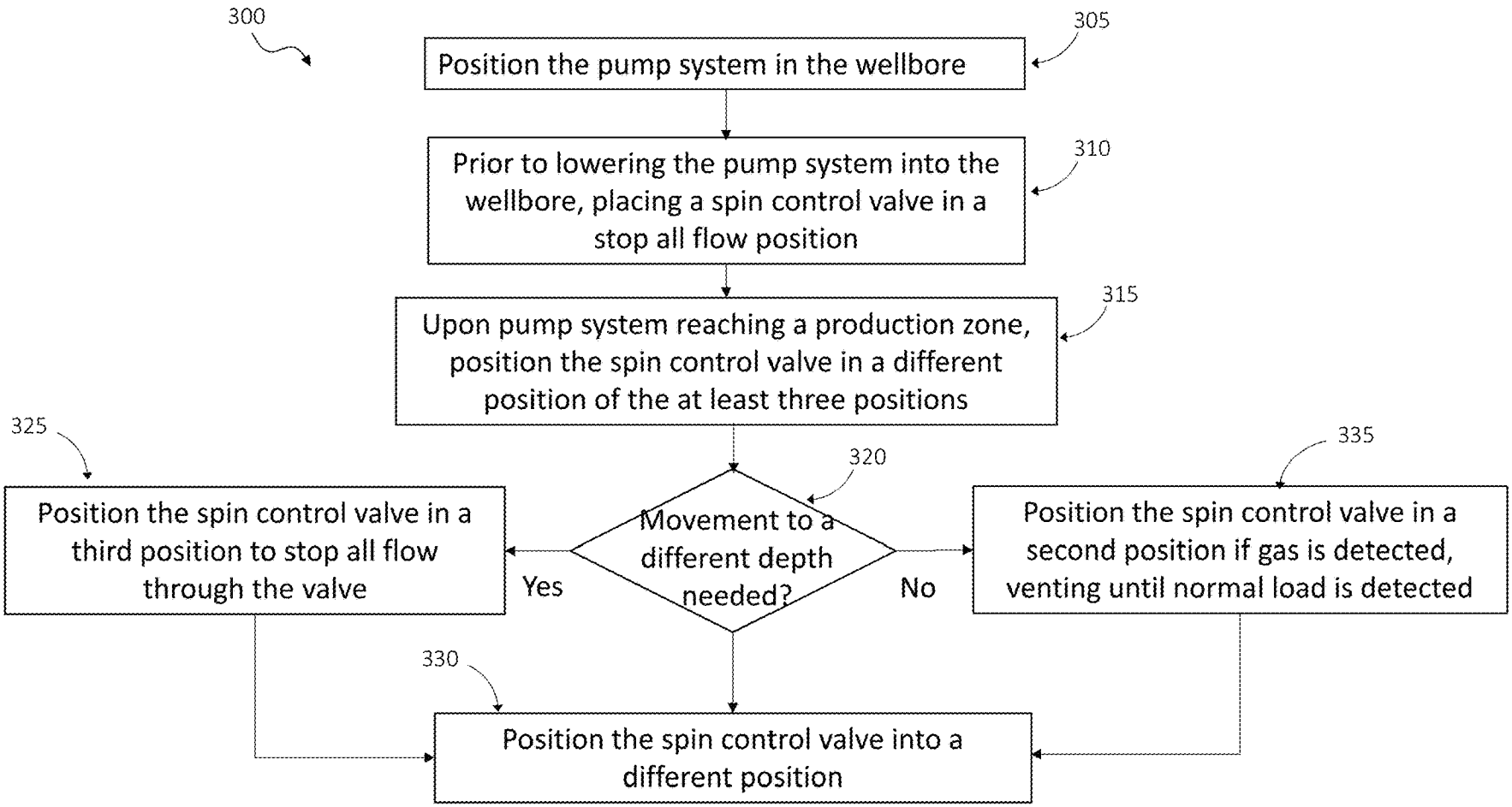
FIG. 3 illustrates one embodiment of a method for anti-spin control of a pump according to one or more embodiments disclosed herein.

FIG. 3 illustrates a method 300 of controlling fluid flow through a pump system using one embodiment of an anti-spin control system according to one or more aspects of the present disclosure. At step 305, a pump system is positioned or disposed in a wellbore where the pump system comprises an anti-spin control system, such as anti-spin control system 200. In one or more embodiments, the pump system may be part of or included with a downhole tool. The pump system may be positioned or disposed such that one or more portions of the pump system are submerged in or otherwise adjacent to a fluid in the wellbore. During positioning and after placement within the wellbore, the flow of fluid through the pump system may need to be adjusted according to wellbore conditions. A spin control valve of the anti-spin control system may be positioned in one of at least three positions according to a desired fluid flow.

At a step 310, prior to positioning the pump system in the wellbore, the spin control valve of the anti-spin control system may be positioned in a third of at least three positions such that the flow rate of the fluid through the spin control valve and the pump system is substantially stopped, described above as the "stop all flow" position.

At a step 315, once the pump system has reached a desired depth within the wellbore, such as a production depth, engaging an actuator to position the spin control valve in a different of the at least three positions. In some embodiments, the spin control valve will be positioned in a first of the at least three positions prior to energization of the pump system such that production fluid may flow through the spin control valve at a first rate.

In a step 320, when movement to a different depth within the wellbore is needed, in a step 325 the spin control valve may be positioned back into the "stop all flow," position to substantially stop all flow through the valve.

When the pump system is no longer moving to a different depth within the wellbore, in a step 330 the spin control valve may be positioned in a different of the at least three positions. If the pump system is still positioned in the wellbore and the flow of production fluid is desired, the spin control valve may be positioned back into either the first position or a second position.

In a step 335, if movement of the pump system is not needed but gas is detected in the production fluid, the spin control valve may be moved into the second position such the production fluid partially or substantially stops through the first stationary valve plate opening and gas may vent back into the wellbore through the second stationary valve plate opening and an exhaust vent into the wellbore. In some embodiments, the second position may also provide an outlet for the fluid contained in the production string but still allows low to no flow through the pump system.

Figure 4:
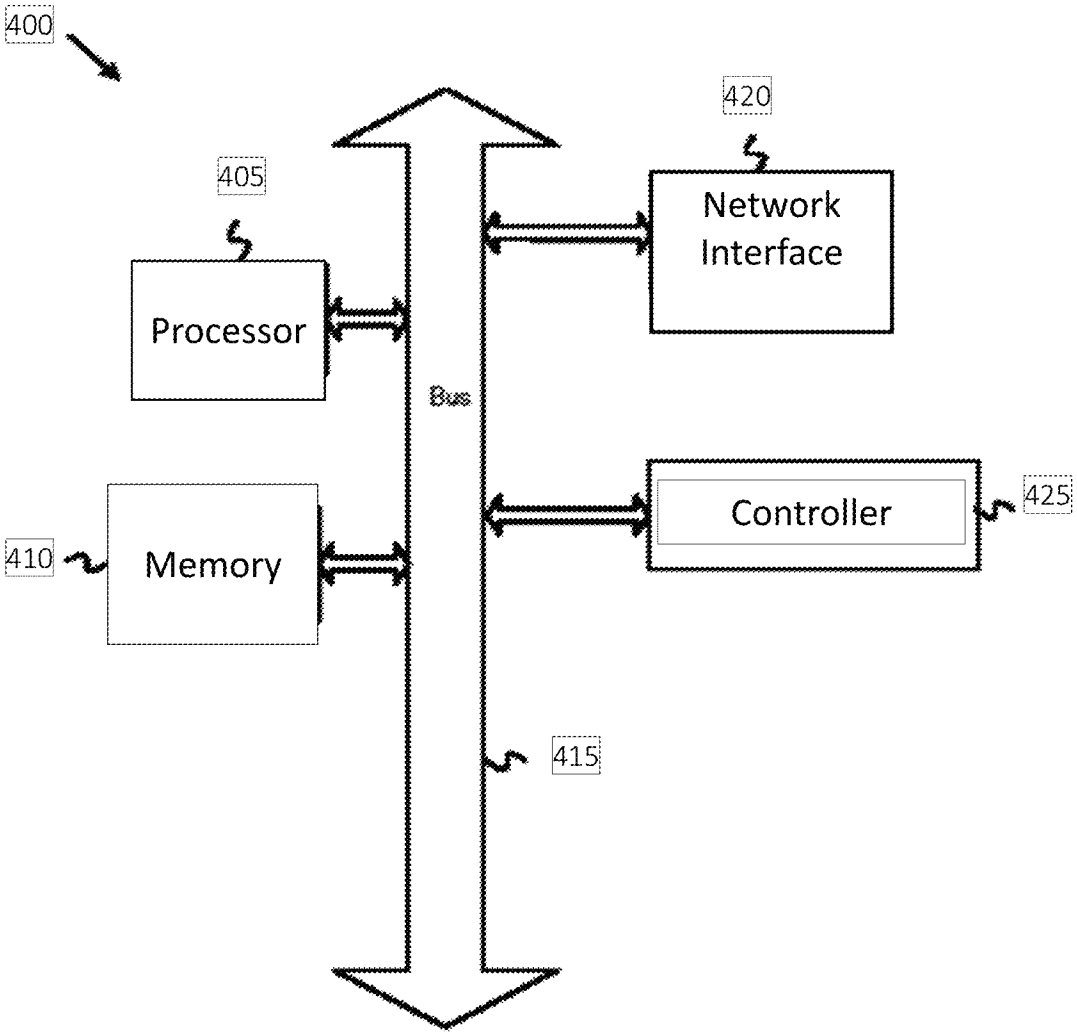
FIG. 4 illustrates an example of non-transitory computer system that may be used with the wellbore and anti-spin control system of FIG. 1 and FIG. 2A-2G designed and manufactured according to one or more embodiments disclosed herein.

FIG. 4 depicts an example computer, according to some embodiments. In particular, FIG. 4 depicts a computer 400 that includes a processor 405 (possibly including multiple processors, multiple cores, multiple nodes, and/or implementing multi-threading, etc.). The computer 400 includes a memory 410. The memory 410 may be system memory or any one or more of the above already described possible realizations of machine-readable media. The computer 400 also includes a bus 415 and a network interface 420.

The computer 400 also includes a controller 425. The controller 425 may perform one or more of the functionalities described herein. In some embodiments, the controller 425 may be coupled with an actuator of an anti-spin control system coupled with a pump system. The controller 425 may be configured to detect a movement of a pump system within a wellbore to different a depth and communicate with the actuator for controlling a spin control valve. The controller may also be configured to determine a change in power of the actuator, such as current measured in amps, output from a density meter, vibration meter, pressure meter, harmonics meter, etc. and communicate with the actuator to move the anti-spin control valve according to the detection device used. Any one of the previously described functionalities may be partially (or entirely) implemented in hardware and/or on the processor 405. For example, the functionality may be implemented with an application specific integrated circuit, in logic implemented in the processor 405, in a co-processor on a peripheral device or card, etc. Further, realizations may include fewer or additional components not illustrated in FIG. 4 (e.g., video cards, audio cards, additional network interfaces, peripheral devices, etc.). The processor 405 and the network interface 420 may be coupled to the bus 415. Although illustrated as being coupled to the bus 415, the memory 410 may in some embodiments be coupled to the processor 405.

Aspects disclosed herein include:

A: A spin control valve assembly, comprising: a stationary valve plate having a first stationary valve plate opening and a second stationary valve plate opening; and a rotating valve plate coupled longitudinally adjacent to the stationary valve plate, the rotating valve plate having a rotating valve plate opening, wherein the rotating valve plate is configured to rotate among at least three positions such that at each position of the at least three positions fluid flows at a different flow rate through the spin control valve assembly.

B: A pump system for use in a wellbore, comprising: a pump having a motor; a spin control system coupled at an uphole end of the pump, the spin control system positioned within a housing and comprising: a first chamber having an actuator positioned therein; a second chamber configured for fluid flow therethrough; and a spin control valve assembly positioned at a downhole end of the first and second chamber and coupled with the actuator, the spin control valve assembly comprising: a stationary valve plate having a first stationary valve plate opening and a second stationary valve plate opening; and a rotating valve plate coupled longitudinally adjacent to the stationary valve plate, the rotating valve plate having a rotating valve plate opening, wherein the rotating valve plate is configured to rotate among at least three positions such that at each position of the at least three positions fluid is to flow at a different flow rate through the spin control valve assembly.

C: A method, comprising: controlling fluid flow from a pump within a wellbore, the pump including: a motor; a housing coupled uphole of the pump, the housing comprising a first chamber having an actuator positioned therein and a second chamber configured for fluid flow therethrough; and a spin control valve assembly positioned downhole of the first and second chamber and coupled with the actuator, the spin control valve assembly comprising: a stationary valve plate having a first stationary valve plate opening and a second stationary valve plate opening; and a rotating valve plate coupled longitudinally adjacent to the stationary valve plate, the rotating valve plate having a rotating valve plate opening, wherein the rotating valve plate is configured to rotate among at least three positions such that at each position of the at least three positions fluid is to flow at a different flow rate through the spin control valve assembly; and wherein controlling fluid flow includes directing the rotating valve plate to move into one of the at least three positions.

Aspects A, B, and C may have one or more of the following additional elements in combination:

Element 1: wherein, in a first position of the at least three positions, the rotating valve plate opening is aligned with the first stationary valve plate opening such that fluid is to flow through the first stationary valve plate opening and the rotating valve plate opening at a first flow rate.

Element 2: wherein, in a second position of the at least three positions, the rotating valve plate opening is at least partially aligned with the second stationary valve plate opening such that the fluid is to flow through the second stationary valve plate opening at a second flow rate that is less than the first flow rate.

Element 3: wherein, in a third position of the at least three positions, the rotating valve plate opening is positioned between the first stationary valve plate opening and the second stationary valve plate opening such that both the first stationary valve plate opening and the second stationary valve plate opening are covered such there such that the flow of the fluid is substantially stopped.

Element 4: wherein the spin control valve assembly is coupled with a pump for use downhole in a wellbore, wherein the rotating valve plate is placed in the third position as the pump is being moved within the wellbore such that substantially no fluid flows through the spin control valve assembly such that substantially no electric current is generated at a surface of the wellbore by a motor of the pump.

Element 5: wherein the rotating valve plate is coupled with and rotates about a central axis member coupled with the stationary valve plate.

Element 6: wherein the rotating valve plate is controlled by an actuator. The actuator may comprise an electric actuator, a hydraulic actuator, a magnetic actuator, or a pneumatic actuator, and in some embodiments may be a combination of types of actuators.

Element 7: wherein the actuator is coupled with a controller positioned at a surface of a wellbore.

Element 8: wherein the first stationary valve plate opening aligns with the second chamber and the second stationary valve plate opening aligns with an exhaust port.

Element 9: wherein the pump is an electric submersible pump (ESP).

Element 10: wherein the motor is a permanent magnet motor (PMM).

Element 11: wherein, directing the rotating valve plate to move includes moving the rotating valve plate to a first position of the at least three positions, wherein the rotating valve plate opening is aligned with the first stationary valve plate opening such that fluid is to flow through the first stationary valve plate opening and the rotating valve plate opening at a first flow rate.

Element 12: wherein directing the rotating valve plate to move includes moving the rotating valve plate to a second position of the at least three positions, wherein the rotating valve plate opening is at least partially aligned with the second stationary valve plate opening such that the fluid is to flow through the second stationary valve plate opening at a second flow rate that is less than the first flow rate such that gas may be vented back into the wellbore.

Element 13: wherein, directing the rotating valve plate to move includes moving the rotating valve plate to a third position of the at least three positions, wherein the rotating valve plate opening is positioned between the first stationary valve plate opening and the second stationary valve plate opening such that both the first stationary valve plate opening and the second stationary valve plate opening are covered such there such that the flow of the fluid is substantially stopped.

Element 14: wherein the rotating valve plate is controlled by an actuator.

Element 15: wherein the actuator is coupled with a controller positioned at a surface of a wellbore.

Those skilled in the art to which this application relates will appreciate that other and further additions, deletions, substitutions and modifications may be made to the described embodiments.

What is claimed is:

1. A spin control valve assembly, comprising:

a stationary valve plate having a first stationary valve plate opening and a second stationary valve plate opening, wherein the first stationary valve plate opening is a different size than the second stationary valve plate opening; and a rotating valve plate coupled longitudinally adjacent to the stationary valve plate, the rotating valve plate having a rotating valve plate opening, wherein the rotating valve plate is configured to rotate among at least three positions such that at each position of the at least three positions fluid flows at a different flow rate through the spin control valve assembly;

wherein the rotating valve plate is coupled to and rotates with an axis member coupled with the stationary valve plate.

2. The spin control valve assembly of claim 1, wherein, in a first position of the at least three positions, the rotating valve plate opening is aligned with the first stationary valve plate opening such that fluid is to flow through the first stationary valve plate opening and the rotating valve plate opening at a first flow rate.

3. The spin control valve assembly of claim 2, wherein, in a second position of the at least three positions, the rotating valve plate opening is at least partially aligned with the second stationary valve plate opening such that the fluid is to flow through the second stationary valve plate opening at a second flow rate that is less than the first flow rate.

4. The spin control valve assembly of claim 3, wherein, in a third position of the at least three positions, the rotating valve plate opening is positioned between the first stationary valve plate opening and the second stationary valve plate opening such that both the first stationary valve plate opening and the second stationary valve plate opening are covered such there such that the flow of the fluid is substantially stopped.

5. The spin control valve assembly of claim 4, wherein the spin control valve assembly is coupled with a pump for use downhole in a wellbore, wherein the rotating valve plate is placed in the third position as the pump is being moved within the wellbore such that substantially no fluid flows through the spin control valve assembly such that substantially no electric current is generated at a surface of the wellbore by a motor of the pump.

6. The spin control valve assembly of claim 1, wherein the the axis member is a central axis member coupled with the stationary valve plate.

7. The spin control valve assembly of claim 1, wherein the rotating valve plate is controlled by an actuator.

8. The spin control valve assembly of claim 7, wherein the actuator is coupled with a controller positioned at a surface of a wellbore.

9. A pump system for use in a wellbore, comprising:

a pump having a motor;

a spin control system coupled at an uphole end of the pump, the spin control system positioned within a housing and comprising:

a first chamber having an actuator positioned therein;

a second chamber configured for fluid flow therethrough; and a spin control valve assembly positioned at a downhole end of the first and second chamber and coupled with the actuator, the spin control valve assembly comprising:

a stationary valve plate having a first stationary valve plate opening and a second stationary valve plate opening; and a rotating valve plate coupled longitudinally adjacent to the stationary valve plate, the rotating valve plate having a rotating valve plate opening, wherein the rotating valve plate is configured to rotate among at least three positions such that at each position of the at least three positions fluid is to flow at a different flow rate through the spin control valve assembly.

10. The pump system of claim 9, wherein the first stationary valve plate opening aligns with the second chamber and the second stationary valve plate opening aligns with an exhaust port.

11. The pump system of claim 9, wherein, in a first position of the at least three positions, the rotating valve plate opening is aligned with the first stationary valve plate opening such that fluid is to flow through the first stationary valve plate opening and the rotating valve plate opening into the second chamber at a first flow rate.

12. The pump system of claim 11, wherein, in a second position of the at least three positions, the rotating valve plate opening is at least partially aligned with the second stationary valve plate opening such that the fluid is to flow through the second stationary valve plate opening at a second flow rate that is less than the first flow rate.

13. The pump system of claim 12, wherein, in a third position of the at least three positions, the rotating valve plate opening is positioned between the first stationary valve plate opening and the second stationary valve plate opening such that both the first stationary valve plate opening and the second stationary valve plate opening are covered such that the flow of the fluid is substantially stopped.

14. The pump system of claim 13, wherein the rotating valve plate is placed in the third position as the pump is being moved within the wellbore to such that no fluid flows through the spin control valve assembly such that no electric current is generated by the motor of the pump.

15. The pump system of claim 9, wherein the pump is an electric submersible pump (ESP) and the motor is a permanent magnet motor (PMM).

16. A method, comprising:

controlling fluid flow from a pump within a wellbore, the pump including:

a motor;

a housing coupled uphole of the pump, the housing comprising a first chamber having an actuator positioned therein and a second chamber configured for fluid flow therethrough; and a spin control valve assembly positioned downhole of the first and second chamber and coupled with the actuator, the spin control valve assembly comprising:

a stationary valve plate having a first stationary valve plate opening and a second stationary valve plate opening; and a rotating valve plate coupled longitudinally adjacent to the stationary valve plate, the rotating valve plate having a rotating valve plate opening, wherein the rotating valve plate is configured to rotate among at least three positions such that at each position of the at least three positions fluid is to flow at a different flow rate through the spin control valve assembly; and wherein controlling fluid flow includes directing the rotating valve plate to move into one of the at least three positions.

17. The method of claim 16, wherein, directing the rotating valve plate to move includes moving the rotating valve plate to a first position of the at least three positions, wherein the rotating valve plate opening is aligned with the first stationary valve plate opening such that fluid is to flow through the first stationary valve plate opening and the rotating valve plate opening at a first flow rate.

18. The method of claim 17, wherein directing the rotating valve plate to move includes moving the rotating valve plate to a second position of the at least three positions, wherein the rotating valve plate opening is at least partially aligned with the second stationary valve plate opening such that the fluid is to flow through the second stationary valve plate opening at a second flow rate that is less than the first flow rate such that gas may be vented back into the wellbore.

19. The method of claim 18, wherein, directing the rotating valve plate to move includes moving the rotating valve plate to a third position of the at least three positions, wherein the rotating valve plate opening is positioned between the first stationary valve plate opening and the second stationary valve plate opening such that both the first stationary valve plate opening and the second stationary valve plate opening are covered such there such that the flow of the fluid is substantially stopped.

20. The method of claim 16, wherein the rotating valve plate is controlled by an actuator and wherein the actuator is coupled with a controller positioned at a surface of a wellbore.

* * * * *